US006820385B2

(12) United States Patent
Horn et al.

(10) Patent No.: US 6,820,385 B2
(45) Date of Patent: Nov. 23, 2004

(54) EXTERIOR LOUVERED HURRICANE WINDOW SHUTTERS

(76) Inventors: Jack Horn, 1406 Harbert, Memphis, TN (US) 38104; James Horn, 8916 Forest Breeze, Cordova, TN (US) 38018; Clive Scott, 3136 E. Preswick, Warsaw, IN (US) 46580

( * ) Notice: Subject to any disclaimer, the term of this patent is extended or adjusted under 35 U.S.C. 154(b) by 0 days.

(21) Appl. No.: 10/429,603

(22) Filed: May 5, 2003

(65) Prior Publication Data

US 2004/0003540 A1 Jan. 8, 2004

Related U.S. Application Data

(63) Continuation-in-part of application No. 09/710,178, filed on Jul. 20, 2001, now Pat. No. 6,470,639, and a continuation-in-part of application No. 09/909,571, filed on Jul. 20, 2001, now Pat. No. 6,604,322.

(51) Int. Cl.[7] ..... E06B 7/08
(52) U.S. Cl. ..... 52/473; 52/202; 52/203
(58) Field of Search ..... 52/202, 203, 473

(56) References Cited

U.S. PATENT DOCUMENTS

| | | | | |
|---|---|---|---|---|
| 1,582,111 | A | | 4/1926 | Wogan |
| 1,718,754 | A | | 6/1929 | Molina |
| 1,866,146 | A | | 7/1932 | Yurkovitch |
| 2,281,071 | A | | 4/1942 | Knudsen |
| 2,771,643 | A | | 11/1956 | Zelov |
| 2,836,529 | A | | 5/1958 | Morris |
| 2,873,827 | A | | 2/1959 | Adamson |
| 2,877,840 | A | | 3/1959 | Hurowitz et al. |
| 2,940,137 | A | | 6/1960 | Blake |
| 3,086,442 | A | | 4/1963 | Waldron |
| 3,392,486 | A | | 7/1968 | Luke |
| 3,452,477 | A | | 7/1969 | Sassano |
| 3,550,342 | A | | 12/1970 | South |
| 3,638,383 | A | * | 2/1972 | Escudero Ribas ..... 52/473 |
| 3,797,186 | A | | 3/1974 | Smith |
| 3,810,338 | A | | 5/1974 | Wolfert |
| 3,812,772 | A | | 5/1974 | Kaiser |
| 3,830,146 | A | | 8/1974 | Kaiser |
| 3,886,703 | A | | 6/1975 | Rousey |
| 4,020,609 | A | | 5/1977 | Daniels |
| 4,049,038 | A | | 9/1977 | Hyman et al. |
| 4,069,632 | A | | 1/1978 | Bode et al. |
| 4,193,232 | A | | 3/1980 | Almsted et al. |
| 4,242,836 | A | | 1/1981 | Anderson |
| 4,248,022 | A | | 2/1981 | Walker |
| 4,323,104 | A | | 4/1982 | Guttman |
| 4,327,795 | A | | 5/1982 | Wheeler |
| 4,454,691 | A | | 6/1984 | Mitchell |
| 4,457,106 | A | | 7/1984 | Forquer |
| 4,459,778 | A | | 7/1984 | Ball |
| 4,483,102 | A | | 11/1984 | Edwards |
| 4,495,978 | A | | 1/1985 | Carroll |
| 4,505,069 | A | | 3/1985 | Freeman |
| 4,641,469 | A | | 2/1987 | Wood |
| 4,685,261 | A | | 8/1987 | Seaquist |
| 4,830,898 | A | | 5/1989 | Smith |
| 4,858,400 | A | | 8/1989 | Foyt |
| 4,912,877 | A | | 4/1990 | Strydom |
| 4,967,511 | A | | 11/1990 | Werginz |
| 5,152,116 | A | | 10/1992 | MacGowan |

(List continued on next page.)

*Primary Examiner*—Carl D. Friedman
*Assistant Examiner*—Steve Varner
(74) *Attorney, Agent, or Firm*—Butler, Snow, O'Mara, Stevens & Cannada PLLC

(57) ABSTRACT

The present invention provides an exterior window shutter that is made of thermoplastic resin, has functional louvers, but is still hurricane resistant. The shutter includes a perimeter framework that is adapted to receive a transparent impact resistant member. This impact resistant member is permanently affixed to the perimeter framework to increase structural stability. Additionally, this invention provides a method to make a high strength and structurally stable hurricane resistant louvered shutter.

17 Claims, 6 Drawing Sheets

U.S. PATENT DOCUMENTS 5,191,735 A 3/1993 Ross
5,237,785 A 8/1993 Lukos
5,255,486 A 10/1993 Wang
5,351,459 A 10/1994 Kassl et al.
5,487,243 A 1/1996 Hale et al.
5,524,407 A * 6/1996 Ricard et al. ..... 52/473
5,537,779 A 7/1996 Jackson
5,603,190 A 2/1997 Sanford
5,617,683 A 4/1997 Ney
5,620,037 A 4/1997 Apostolo
5,737,874 A 4/1998 Sipos et al.
5,778,958 A 7/1998 Stebner
5,799,462 A 9/1998 McKinney
5,848,505 A 12/1998 Taylor
5,893,242 A 4/1999 Perron
5,893,248 A 4/1999 Beliveau
5,907,929 A * 6/1999 Poma et al. ..... 52/78
5,941,021 A 8/1999 Valls, Jr. et al.
5,991,047 A 11/1999 Kohlert et al.
5,996,298 A 12/1999 Wenzlaff et al.
6,263,632 B1 7/2001 Cadorette
6,470,639 B1 * 10/2002 Horn et al. ..... 52/309.16
6,604,322 B2 * 8/2003 Horn et al. ..... 49/64

* cited by examiner

EXTERIOR LOUVERED HURRICANE WINDOW SHUTTERS

CROSS-REFERENCE TO RELATED APPLICATIONS

This application is a continuation-in-part of U.S. Ser. No. 09/710,178, filed Jul. 20, 2001, Now U.S. Pat. No. 6,470,639 and a continuation-in-part of U.S. Ser. No. 09/909,571 filed Jul. 20, 2001, now U.S. Pat. No. 6,604,322, both hereby specifically incorporated by reference.

FIELD OF THE INVENTION

The present invention relates to a functional louvered window shutter having an integral high impact sheet of plastic. This shutter has the strength to resist hurricane force winds and resultant debris while still allowing the louvers to function. The invention provides a method to make exterior louvered hurricane window shutters.

DESCRIPTION OF THE RELATED ART

Window shutters have been used for many years, either for decorative purposes, protection during storms, or both. Early shutters were typically made of wood and were subject to several problems including rotting, warpage and dimensional changes due to moisture absorption. More recently, polyvinyl chloride (hereinafter PVC) and other thermoplastic resin have been used to manufacture shutters. Although the use of PVC has solved many problems associated with wooden shutters, existing PVC shutters may still be subject to strength and structural stability problems. This strength and stability problem is further compounded by the desire to have functional louver type shutters made of PVC. One approach, as shown in U.S. Pat. No. 5,941,021, is to provide a means to reinforce the louvered slats with a metal bar. This type of reinforcement is costly and difficult to manufacture. Consequently, a need exists in this industry to produce an outdoor PVC window shutter having functional louvers of sufficient strength and structural stability to pass standard industry testing of severe weather stability, but also to be a design that can be made in an efficient manner.

BRIEF SUMMARY OF THE INVENTION

The present invention provides a window shutter that has both high strength and structural stability. More specifically, it provides a shutter for storm protection of an external opening in a structure having a perimeter framework of PVC having a pair of substantially vertical members spaced apart from each other, a pair of substantially horizontal members spaced apart from each other, the substantially vertical and said substantially horizontal members connect together and defining an interior area, the framework adapted to be attached externally to the structure adjacent to the structure external opening. The perimeter framework having a plurality of support members affixed to the vertical and horizontal members; a plurality of louver slats movably connected to the framework and substantially filling the interior area and a substantially planar one piece transparent impact resistant member permanently connected to the perimeter framework and sized to cover the interior area.

Additionally, this invention provides a shutter for storm protection of an external opening in a structure. This structure includes a perimeter framework of PVC having a pair of substantially vertical members spaced apart from each other, a pair of substantially horizontal members spaced apart from each other. The substantially vertical and the substantially horizontal members connect together and define an interior area. The framework is adapted to be flexibly attached externally to the structure adjacent to the structure's external opening. A plurality of louver slats are movably connected to the framework and substantially fill the interior area. A substantially planar one piece transparent impact resistant member permanently connects to the perimeter framework and is sized to cover the interior area.

Additionally, this invention provides a method to make a high strength and structurally stable outdoor window shutter. This method involves providing a perimeter framework of PVC having a pair of substantially vertical members spaced apart from each other, a pair of substantially horizontal members spaced apart form each other; wherein the substantially vertical and the substantially horizontal members are connected together and define the interior area. The framework is adapted to be flexibly attached externally to the structure adjacent to the structure's external opening. The perimeter framework has a plurality of support members affixed to the vertical and horizontal members. The method further involves movable connecting a plurality of louver slats to said framework and substantially filling the interior area and permanently connecting a substantially planar one piece transparent impact resistant member to the perimeter framework.

The invention also relates to a method to make high strength and structurally stable outdoor window shutters involving the steps of providing a perimeter framework of PVC having a pair of substantially vertical members spaced apart from each other. The substantially vertical and the substantially horizontal members connect together and defining an interior area. The framework adapted to be flexibly attached externally to the structure adjacent to the structure's external opening, moveable connecting a plurality of louver slats to the framework and substantially filling the interior area; and permanently connecting a substantially planar one piece transparent impact resistant member to the perimeter framework.

BRIEF DESCRIPTION OF SEVERAL VIEWS OF THE DRAWING

A more complete understanding of the invention and its advantages will be apparent from the following Description of the Preferred Embodiment(s) taken in conjunction with the accompanying drawings, wherein.

DESCRIPTION OF THE PREFERRED EMBODIMENTS

Figure 2:
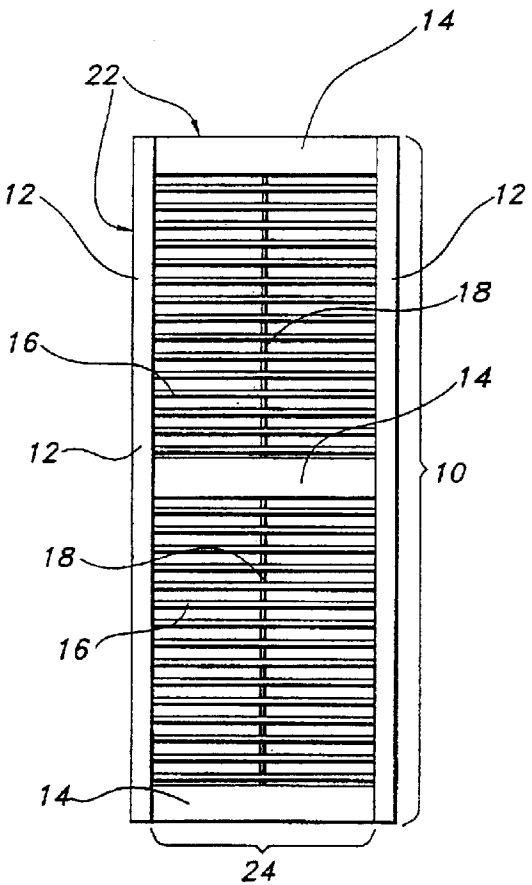
FIG. 2 shows a front view of the louvered window shutter made in accordance with the present invention with the louvers in the open position.
Figure 1:
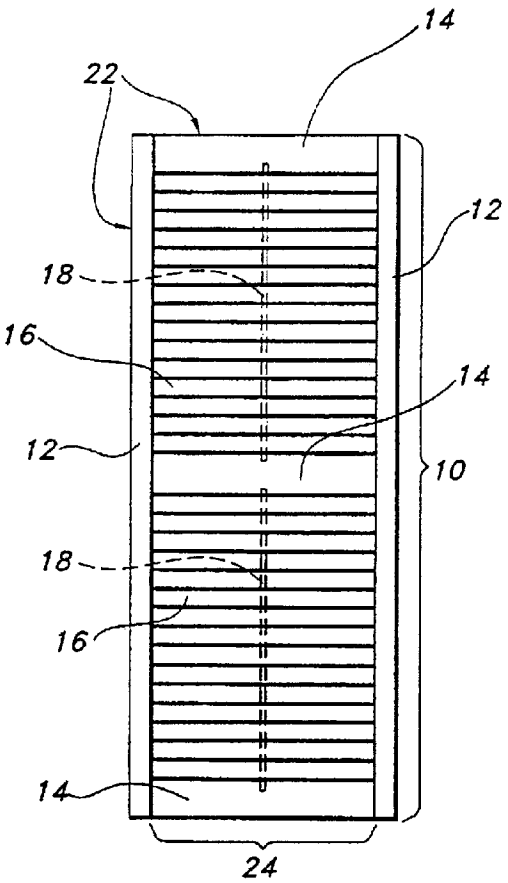
FIG. 1 shows a front view of the louvered window shutter made in accordance with the present invention with the louvers in the closed position.

Referring to FIGS. 1–10 a louvered window shutter 10 is made in accordance with the present invention as illustrated. Louvered window shutter 10 includes: a plurality of stiles 12, a plurality of rails 14, a plurality of slats 16, and a plurality of tilt rods 18. The slats 16 are shown in the closed position in the embodiment shown in FIG. 1 and in the open position in FIG. 2. An impact resistant retaining member 26 holds a transparent sheet of impact resistant plastic 28, such as polycarbonate. A stile 12 is a vertical cross member that interlocks with a rail 14 to form a perimeter framework 22. A rail 14 is a horizontal member that interlocks with a stile 12 to form a perimeter framework 22. FIG. 2 shows the same louvered window 10 in the open position. More specifically, this invention relates to a perimeter framework 22 of PVC having a pair of substantially vertical members 12 (also referred to as stiles) spaced apart from each other, a pair of substantially horizontal members 14 (also referred to as rails) spaced apart from each other. The substantially vertical members 12 and the substantially horizontal members 14 connecting together with defining an interior area 24.

Figure 4:
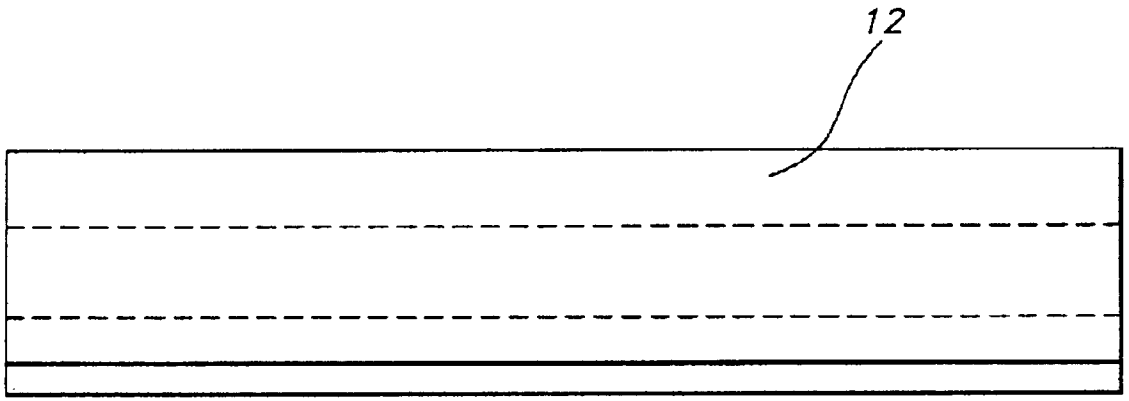
FIG. 4 shows a front view of a vertical support member.
Figure 3:
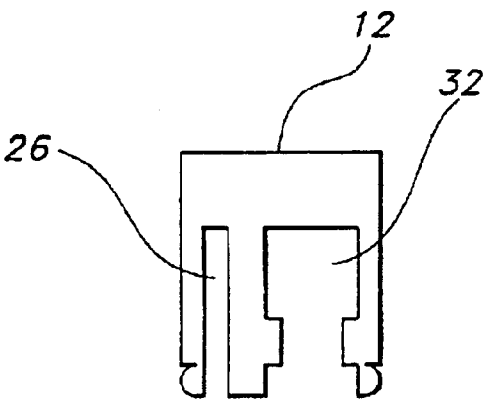
FIG. 3 shows an end view of a vertical support member.

Now referring to FIGS. 3 and 4, end and front views of vertical member 12 are shown respectively. The vertical member 12 is extruded from rigid PVC foam in 150-in. lengths. In the preferred embodiment the plastic sheet is polyvinyl chloride, but any thermoplastic resin of the appropriate properties can be used. These properties are excellent corrosion resistance and high strength to weight ratio. The PVC extrusion has a notched shaped recessed area 32 to receive a portion of horizontal member 14. Additionally, the vertical member 12 has a second more liner recessed area 26 to accept the impact resistant member 28. It should be noted that the shapes depicted in FIG. 3 are representative and any notched shape can be used to from the perimeter framework 22. Similarly, any notch shape cab be used to retain the impact resistant member, but the linear notch 26 is the preferred embodiment.

The framework 22 is adapted to be attached externally to a structure adjacent to the structure's external opening. The hinges to be used will vary upon application. The primary will be 2" to 4" stainless steel plates that attach to the shutter and building structure. A stainless steel storm bar will be applied horizontally that will attach to the shutter and the building structure.

Figure 5A:
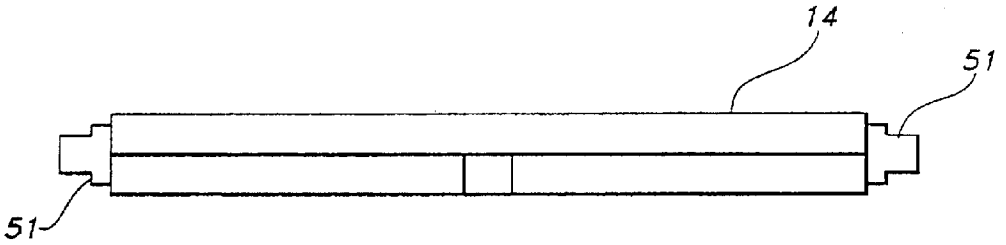
FIG. 5A shows a top view of a horizontal support member.
Figure 5B:
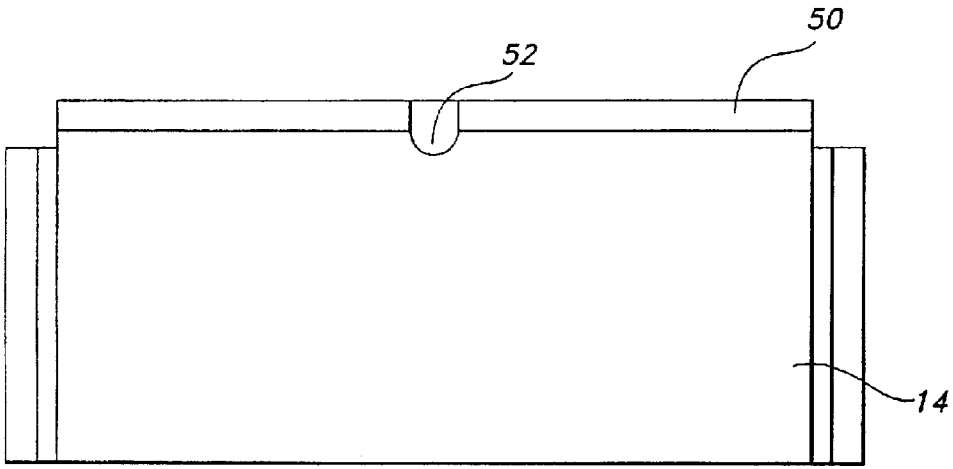
FIG. 5B shows a front view of a horizontal support member.
Figure 5C:
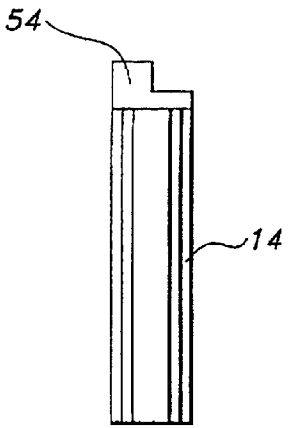
FIG. 5C shows an end view of a horizontal support member.

Now referring to FIGS. 5A–5C horizontal members 14 are shown. The horizontal members 14 are generally about 1–2 inches shorter than the panel width and have a plurality of ends 51 adapted to fit into the groove 32 in the vertical members 12. In FIG. 5B a front view of the horizontal member 14 shows the bottom horizontal member 50 has a recessed notch 52 to accommodate end of tilt rod 18 when shutter 10 is in the closed position. An end view of the horizontal member, as depicted in FIG. 5C, shows a projection 54 to block light beneath the bottom louver.

Figure 6:
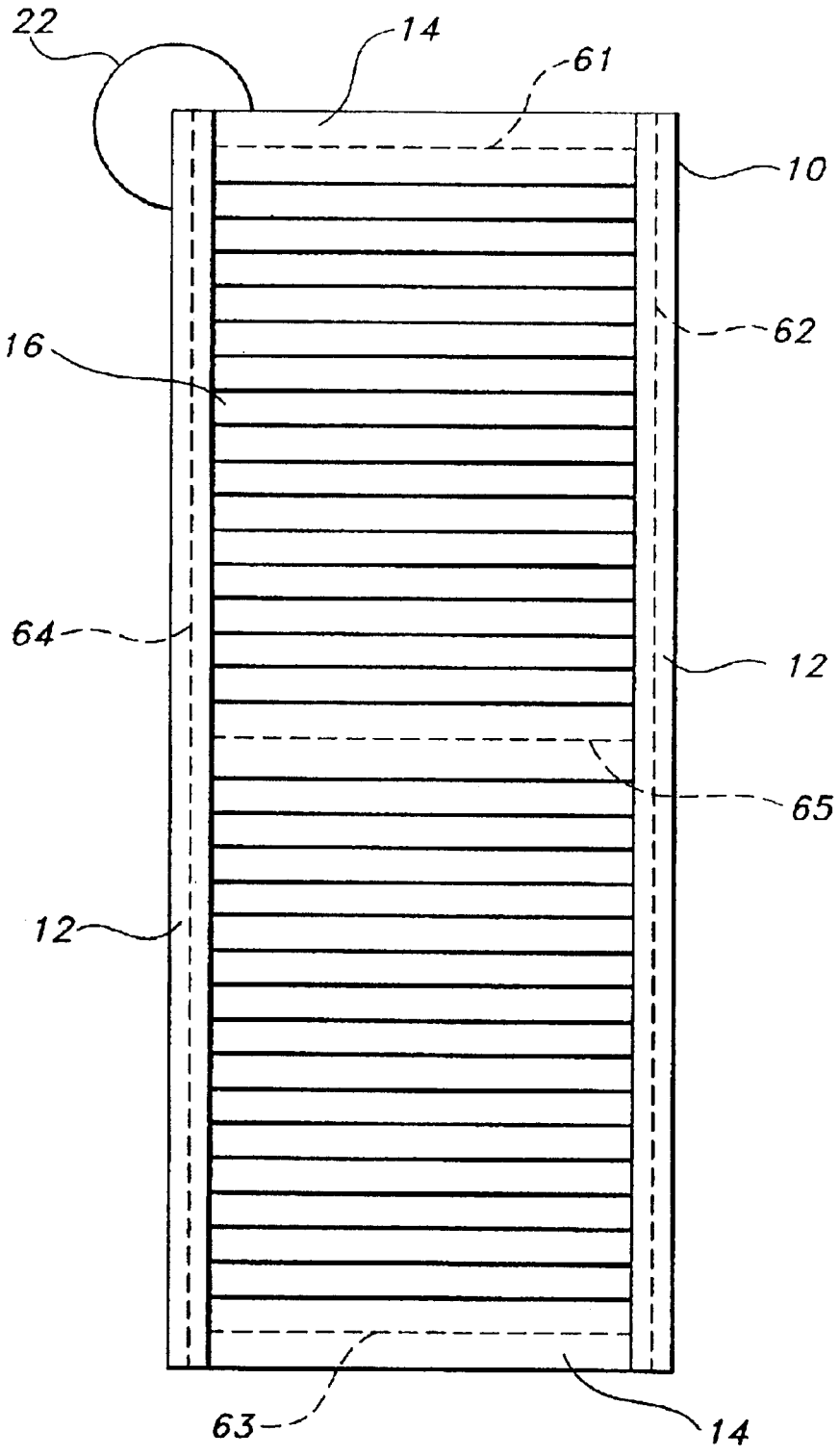
FIG. 6 shows a back view of the louvered shutter with support members shown with hidden detail lines.

Now referring to FIG. 6, the perimeter framework 22 has a plurality of support members affixed in the vertical 12 and horizontal 14 members. The desired strength and stability of these window shutters are obtained by using at least one support member affixed in or on the perimeter framework 22. Exterior window shutters made with PVC with at least one support member affixed in the panel are disclosed in U.S. patent application Ser. No. 09/710,178 (hereby incorporated by reference). Referring to FIG. 6, the back of shutter 10 is shown. The perimeter framework 22 has at least one support member in the horizontal 12 or vertical 14 members. The support member is rigid and is made of a rigid, lightweight material, such as aluminum. The support member can have various shapes, such as "L" shaped "T" shaped, rectangular or circular depending on the application. The support member is arranged in the channel to provide support and stability for the louvered window shutter. In the preferred embodiment shown in FIG. 6, the support members 61–65 are shown by hidden detail lines to form a figure "8". This configuration of support members has shown the needed strength and stability for use with a hurricane resistant shutter. If desired, however, if it is possible to make the shutters without a support member, but in this configuration they would not provide hurricanes resistance.

Figure 7:
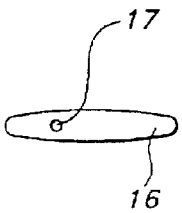
FIG. 7 shows an end view of a louver.
Figure 8:
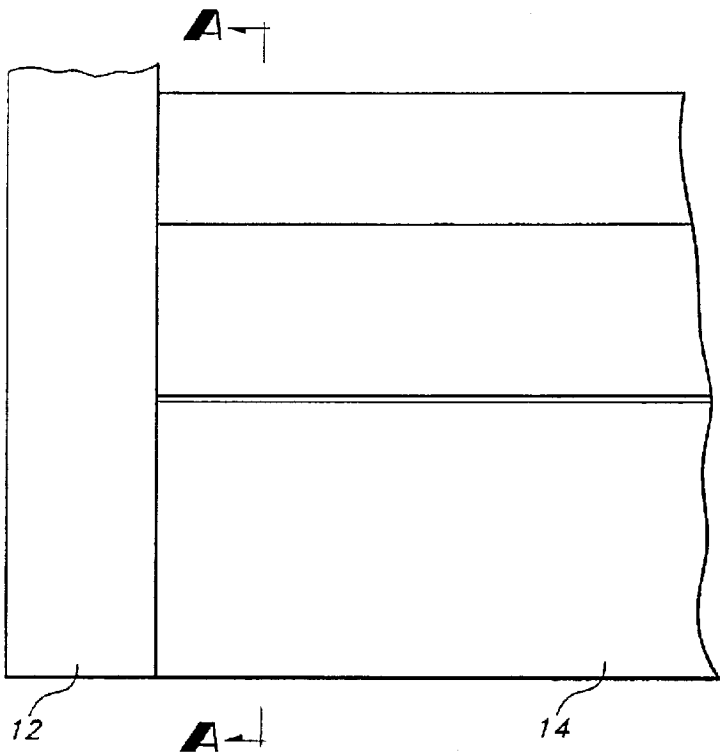
FIG. 8 shows a partial front view of a louver showing where a sectional view is taken at A—A.
Figure 9:
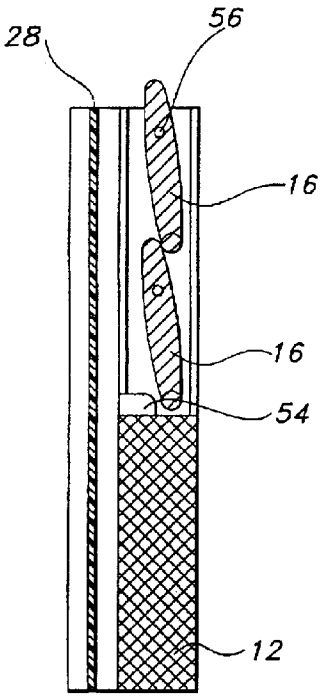
FIG. 9 shows a sectional view of a louver taken at A—A and stile.

Now referring to FIGS. 7–9 of plurality of louvers 16 are movably connected to the framework 22 and substantially fill the interior area 24. The louvers 16 are connected to the vertical members 12 by placing a pin in opening 17 of slat 16 and opening 56 in vertical member 12. The louver 16 is moveably affixed to vertical member 12. The louvers are attached to the stiles by the use of vinyl pins. This allows the louvers to operate. A hole is drilled into the end of the louver, pins are inserted and the head of the pin fits into the hole strip 100 on the stile. However, the louvers 16 can be attached to the perimeter framework 22 by any conventional means. A substantially planar one piece transparent impact resistant member 28 is affixed in groove 26 in vertical members 12. The impact resistant member can be polycarbonate or any transparent impact resistant material. The impact resistant member is sized to cover the interior area 24. The impact resistant member 28 is glued in place and can be additionally fixed with screws. A PVC outdoor window shutter having functional louvers 16, at least one supporting member 61–65 in the perimeter framework 22 and an impact resistant member 28 of sufficient strength, is able to pass standard industry testing for severe weather stability. These shutters can also be made in an efficient manner.

Manufacturing of Reinforced Louvered Window Shutter 10: To make a louvered shutter 10, two stiles 12 are prepared for each louvered shutter 10. A stile 12 is made by extruding PVC through a mold that would provide that shape shown in FIG. 3. These stiles 12 are cut to the finished height of the louvered shutter 10 using a chop saw fitted with an adjustable cutting guide. Two lengths of reinforcing bar are cut to the same length as the stile 12. They are coated along the entire length with glue and slid into the stiles. When assembled each stile 12 will have a ½-in. square hole in each end that will be glued into place with adhesive. The assembly is left to "fix cure" for 15 minutes. Two series of holes are then drilled into stiles 12 that will allow for the later permanent assembly of the polycarbonate sheet to the shutter. The first series of holes are drilled using a 7/32 in. drill bit, which is the tapping size of ¼-in. 20 bolts. This hole passes through both the stile 12 and the reinforcing member 64, which is preferably an aluminum bar. The hole is drilled on the slotted side of the stile 12 corresponding to the center position of each rail when it is subsequently installed. These holes are drilled on a drill press. A second drill press, fitted with a 9/32-in. drill (clearance for 14-in-20 bolt), is drilled through the stile until it hits the reinforcing member. After drilling, the stile 12 is moved to a third drill press, this one fitted with an automated tapping head fitted with a ¼-in-20 tap. This is used to tap the reinforcing member at each of the drilled hole locations.

Rails 14 are made from 1-in. thick PVC which comes in the form of 4' by 8' sheets. The sheets are cut into strips and routed on a CNC router. The CNC router routs one edge of the rail strip to provide clearance for the leading and trailing edges of the top and bottom louver in the final assembly. The router also routes a 3/16 in. channel along each section. This will later be used to install a reinforcing member in each rail used in the shutter. The rails are then cut to the desired length on a conventional table saw. Both ends of each rail 14 are then routed to provide for a mortise and tenon joint with the stile 12 at the final assembly operation. The ends of this routed rail 14 are notched to provide a location datum for the hole strip in the final assembly.

If the shutter 10 has additional rails these have to be cut to the desired width, and routed along each leading edge (on different sides) to allow for the leading edge of the corresponding louvers. A typical shutter has three rails with one usually in the middle. It corresponds to the position of the mullion in the window to which the shutter is finally installed. Referring now to FIG. 5, in the next operation, a slot 52 is added in the front leading edge of the rails, into which the tilt rod fits during operation of the finished shutter.

The final step in the fabrication of the rail 14 is the glued installation of reinforcing members. This is the same type of bar used in the stiles 12. The bar is cut to the length of the rail less 1/1/3-in. and glued using 3M adhesive into the routed slot. In one embodiment each bar has a drilled and tapped hole for a ¼-in.-20 bolt in the middle of the full long side. The bolt will fit snugly over this reinforcing member at assembly and will be drilled to allow for installation of a stainless steel bolt into the hole in the crossbar. This bolt provides impact and deflection strength to the final assembly.

Now referring to FIGS. 7–9 the louvers 16 are made cut to the desired length on a chop saw. They then have a 3/32-in. hole drilled in each end. This operation is performed on a drilling machine that accurately locates and drills both holes at the same time. Into each of these holes is placed a louver pin. This pin provides the axis of rotation for the louver when installed into the hole strip during final assembly. The shutter pin is made of vinyl and is purchased from Lintec Inc. The shutter pin allows the louvers to be rotated and then stay in position. At the same time the machine installs a 5/6-in. long square shanked stainless steel staple into the middle leading edge of the louver 16. In this way louver 16 can be installed on the tilt rod 18. The number of louvers required and their length is directly proportional to the height and width of the shutter. In the preferred embodiment there are 4 louvers per 10" of stile. The tilt rod 18 is a means to allow the shutter slats or louvers to move from the open to the closed position. The tilt rod is cut to length. The tilt rod runs from a notch in the top rial to bottom louvers, for both louvered panels. One end of the tilt rod is machined into a semi-circle using a router and the other is left square.

The tilt rod 18 is assembled to its group of louvers 16 using a staple machine. The tilt rod 18 is placed on a rail in staple machine so that it can pass under staple gun incremental 2-in. movements. A solid stop is provided on the staple machine to determine the location of the first staple. When the machine indexes to the first insertion point a precut louver is placed under the stapler head with the stapled leading edge directly under the staple gun of the staple machine. The gun then installs a second stainless steel staple through the first one and onto the body of the tilt rod 18. This step is repeated until the end of the tilt rod is reached. The resulting assembly of louvers to the tilt rod is called the louver tree. The tilt rod is attached to the louvers by the following process: a louver machine first drills the ends of the louvers to insert louver pins, and then a staple is inserted on the edge of the louver directly in the middle. The tilt rod machine places the tilt rod in a sliding holder, the louvers are placed in the staple machine and each louver is then stapled to the tilt rod.

The impact resistant member 28 is a polycarbonate sheet. In the preferred embodiment, the impact resistant member 28 is made by cutting a ⅛ in. sheet of Lexan® to its desired size, i.e. the same size as the window shutter panel 10 on a conventional panel saw using a HSS fine toothed cross cut blade.

Figure 10:
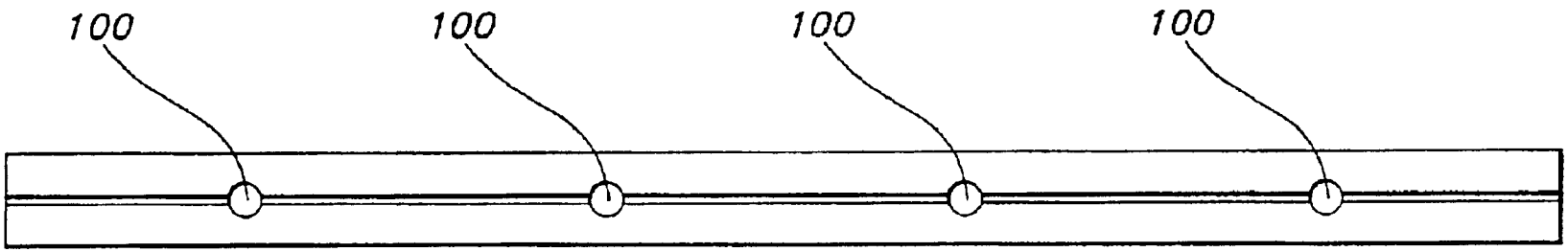
FIG. 10 shows a front view of hole strips.

Now referring to FIG. 10 a plurality hole strips 100 are shown. Hole strips 100 provide the spacing for the louvers relative to the rails in the final assembly. The hole strip 100 is a rectangular section of PVC with ¼-in. holes punched along its length at 2-in. intervals. Into these holes fit the pins in each louver. The first operation in the fabrication of the hole strip is to cut the end of the strip on a chop saw so that the location of the first hole will allow the louvers to fit correctly into the shutter assembly. The dies require the hole strip to be inserted into the stile then slid up slid up to be flush with the divider rail. The hole strips are precut using a jig that measures the length of the hole strip by the number of louvers to be used. The location of the second cut is determined by counting the number of holes required to provide a location for each of the louvers on the corresponding louver tree. The hole strip 100 is then glued into the stile assembly using the 3M glue. To position the hole strip relative to the stile, the fabricated rails made for the shutter are used.

A louver tree is placed on a holding rail in the glue-up table which spaces them 2-in. apart and holds them vertically with the tilt rod on top. One of the two stile assemblies is then positioned on one side of the louver tree. Into the other stile assembly are glued the pre-machined rails. The rail-stile joint is a mortise and tenon, glued and Loctite Prism® adhesive. The mortised ends of the rail fit into the tenon joint made by the edges of the stile and the glued in hold strip. This rail-stile assembly is placed on the other side of the glue-up table.

Closing the jaws of the louver table then brings the assembly together. Loctite Prism® adhesive is applied prior to the rails mating with the second stile. During the final closing of the jaws a woodworking square is used to ensure that the rails and stiles remain at about a 90 degree angle relative to each other. This is essential for the correct operation of the assembled shutter. The final closure of the jaws applies pressure to the assembly so that air is forced out of the mortise and tenon joints. The assembled shutter is then left for three minutes in the table to allow the adhesive to reach fixture strength. The shutter is then taken from the table and placed in a vertical position within a curing rack. The shutter is left on the rack to allow for a final curing of the adhesive for no less than two hours.

When fully cured the shutter 10 is removed from the rack and placed (tilt rod down) on large table with a carpeted surface. The pre-cut Lexan® sheet is then slid into the corresponding grooves and pushed all the way in until flush with the bottom of the shutter. Holes are then drilled through the Lexan® with the 9/32-in. HSS drill to allow for the insertion of the ¼-in.-20 stainless bolts that permanently affix the Lexan® sheet within the shutter. After drilling the Lexan® the bolts are installed. The shutter is ready to be painted with Polane® Two Part epoxy paint.

A louvered shutter made in accordance with the above described manufacturing technique has high strength and stability and can be used as a hurricane resistant shutter.

While we have illustrated and described several embodiments of the invention, it will be understood that these are by way of illustration and that various changes may be contemplated in this invention within the scope of the following claims.

We claim:

1. A shutter for storm protection of an external opening in a structure, comprising:

(a) a perimeter framework of a thermoplastic resin having a pair of substantially vertical members spaced apart from each other, a pair of substantially horizontal members spaced apart from each other, said substantially vertical and said substantially horizontal members connect together and defining an interior area, said framework adapted to be attached externally to said structure adjacent to said structure's external opening, wherein said perimeter framework is flexibly connected to said structure;

(b) a plurality of louver slats movably connected to said framework and substantially filling said interior area; and (c) a substantially planar transparent impact resistant member permanently connected to said perimeter framework and sized to cover said interior area.

2. The shutter of claim 1 wherein said thermoplastic resin is polyvinyl chloride.

3. The shutter of claim 1 wherein said plurality of louver slats are connected to a tilt rod.

4. The shutter of claim 1 wherein said pair of horizontal members includes means to block light.

5. The shutter of claim 1 wherein said impact resistant member is sized to cover said interior area.

6. The shutter of claim 1 wherein said plurality of support members form a figure "8".

7. The shutter of claim 1 wherein said plurality of support members are made from aluminum.

8. The shutter of claim 1 wherein said impact resistant member is made from polycarbonate.

9. The shutter of claim 1 wherein said perimeter framework has at least one support member affixed in said substantially vertical or said substantially horizontal member.

10. A method to make high strength and structurally stable outdoor window shutters comprising the steps of:

(a) providing a perimeter framework of a thermoplastic resin having a pair of substantially vertical members spaced apart from each other, a pair of substantially horizontal members spaced apart from each other, said substantially vertical and said substantially horizontal members connect together and defining an interior area, said framework adapted to be attached externally to said structure adjacent to said structure's external opening, said perimeter framework having a plurality of support members affixed in said vertical and horizontal members;

(b) movable connecting a plurality of louver slats to said framework and substantially filling said interior area;

(c) permanently connecting a substantially planar one piece transparent impact resistant member to said perimeter framework; and (d) flexibly connecting said perimeter framework to said structure.

11. The method of claim 10 wherein said impact resistant member is sized to cover said interior area.

12. The method of claim 10 wherein said plurality of support members form a figure "8".

13. The method of claim 10 wherein said plurality of support members are made from aluminum.

14. The method of claim 10 wherein said impact resistant member is made from polycarbonate.

15. The method of claim 10 wherein said plurality of louver slats are connected to a tilt rod.

16. The method of claim 10 wherein said pair of horizontal members includes means to block light.

17. The method of claim 10 wherein said perimeter framework has at least one support member affixed in said substantially vertical or said substantially horizontal member.

* * * * *